US011067373B2

(12) United States Patent
Son

(10) Patent No.: US 11,067,373 B2
(45) Date of Patent: Jul. 20, 2021

(54) AIRBURST MUNITION AND AIRBURST SIGNAL TRANSFER DEVICE

(71) Applicant: SENSORPIA CO., Daejeon (KR)

(72) Inventor: Derac Son, Daejeon (KR)

(73) Assignee: SENSORPIA CO., Daejeon (KR)

( * ) Notice: Subject to any disclaimer, the term of this patent is extended or adjusted under 35 U.S.C. 154(b) by 0 days.

(21) Appl. No.: 16/826,137

(22) Filed: Mar. 20, 2020

(65) Prior Publication Data

US 2020/0370871 A1 Nov. 26, 2020

(30) Foreign Application Priority Data

May 23, 2019 (KR) ..... 10-2019-0060669

(51) Int. Cl.
*F42C 11/00* (2006.01)
*F42B 12/20* (2006.01)
*F42C 11/06* (2006.01)

(52) U.S. Cl.
CPC ..... *F42B 12/202* (2013.01); *F42C 11/065* (2013.01)

(58) Field of Classification Search
CPC ..... F42C 11/065; F42C 15/40; F42C 17/04; F41A 21/00; F42B 12/202
See application file for complete search history.

(56) References Cited

U.S. PATENT DOCUMENTS 9,513,308 B2 * 12/2016 Jung ..... F42C 9/00
2014/0007760 A1 * 1/2014 Frick ..... F42C 11/065 89/6.5
2014/0060298 A1 3/2014 Mueller et al.

FOREIGN PATENT DOCUMENTS

KR 10-2014-0045937 A 4/2014
KR 10-1823517 B1 1/2018
KR 10-1890362 B1 8/2018
KR 10-1968326 B1 4/2019

* cited by examiner

*Primary Examiner* — J. Woodrow Eldred

(57) ABSTRACT

Disclosed are an airburst munition and an airburst signal transfer device. By simply signaling information regarding a distance to an explosion location of the airburst munition to an explosion control system inside the airburst munition while the airburst munition passes through a tubular body of the airburst signal transfer device, it is possible to easily, simply, and automatically enter the information regarding the distance to the explosion location of the airburst munition to the airburst munition using the airburst signal transfer device.

8 Claims, 4 Drawing Sheets

AIRBURST MUNITION AND AIRBURST SIGNAL TRANSFER DEVICE

CROSS-REFERENCE TO RELATED APPLICATION(S)

This application claims priority from Korean Patent Application No. 10-2019-0060669, filed on May 23, 2019, in the Korean Intellectual Property Office, the disclosure of which is incorporated herein by reference in its entirety.

BACKGROUND

1. Field

The following description relates to an airburst munition that reaches an explosion location and then explodes in the air and an airburst signal transfer device for shooting the airburst munition.

2. Description of Related Art

Korean Patent No. 10-1823517 (registered on Jan. 24, 2018) discloses an airburst munition fuse including a timer, a single-axis geomagnetic sensor, a ground detection sensor, and a detonation controller and a method of controlling detonation of an airburst munition.

According to this technique, the ground detection sensor detects a rising trigger and a falling trigger from a result of binarizing a geomagnetism detection result measured by the single-axis geomagnetic sensor, and the detonation controller controls the timer to be operated only when a rising trigger is detected and ignites an airburst munition when a detonation time pre-input to the airburst munition is reached.

In the case of such an airburst munition, a distance to an explosion location of the airburst munition has to be accurately input. The present inventor has studied a technology that can easily signal, to an explosion control system in an airburst munition, information regarding a distance to the explosion location of the airburst munition while the airburst munition passes through a tubular body of an airburst signal transfer device.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

The following description relates to an airburst signal transfer device configured to simply signal information regarding a distance to an explosion location of an airburst munition to an explosion control system inside the airburst munition while the airburst munition passes through a tubular body.

The following description also relates to an airburst munition configured to simply set an explosion timer of an airburst munition using information regarding a distance to an explosion location of the airburst munition which is simply detected while the airburst munition passes through a tubular body of an airburst signal transfer device.

The following description also relates to an airburst munition and an airburst signal transfer device capable of preventing the airburst munition from exploding inside a firing barrel due to an error in an explosion timer.

In one general aspect, there is provided an airburst signal transfer device including a tubular body through which an airburst munition is to pass, and multiple signal transfer units disposed at regular intervals along the tubular body and configured to deliver, to an explosion control system inside the airburst munition passing through the tubular body, multi-bit information including information regarding a distance to an explosion location of the airburst munition.

In an additional aspect, the signal transfer units include a start signal transfer unit disposed near an entrance of the tubular body and configured to output starting point information, an end signal transfer unit disposed near an exit of the tubular body and configured to output ending point information, and multiple data signal transfer units disposed between the start signal transfer unit and the end signal transfer unit and configured to output the information regarding the distance to the explosion location of the airburst munition.

In an additional aspect, the signal transfer units further include an explosion prevention signal transfer unit disposed immediately in front of the end signal transfer unit and configured to output a parity bit for preventing the airburst munition from exploding inside a firing barrel in order to prevent the airburst munition from exploding inside the firing barrel due to an error in an explosion timer inside the airburst munition.

In an additional aspect, the airburst signal transfer device further includes multiple driving power suppliers configured to supply power for driving the multiple signal transfer units.

In an additional aspect, each of the driving power suppliers may be an H-bridge configured to control a direction of an electric current flowing through a corresponding signal transfer unit.

In an additional aspect, the airburst signal transfer device further includes a controller configured to output an electric-current direction control signal to each H-bridge depending on the distance to the explosion location of the airburst munition.

In an additional aspect, the airburst signal transfer device further includes a distance information input part configured to receive the information regarding the distance to the explosion location of the airburst munition.

In another general aspect, there is provided an airburst munition including an explosion control system for performing airburst control of the airburst munition, the explosion control system including a signal detector configured to detect signals from multiple signal transfer units disposed at regular intervals along a tubular body of an airburst signal transfer device when the airburst munition passes through the tubular body of the airburst signal transfer device; and an explosion controller configured to recognize a distance to an explosion location of the airburst munition and calculate an initial speed of the airburst munition on the basis of the signals detected from the multiple signal transfer units, predict an arrival time at the explosion location of the airburst munition on the basis of the recognized distance to the explosion location of the airburst munition and the calculated initial speed of the airburst munition, and set an explosion timer inside the airburst munition.

In an additional aspect, the explosion controller calculates the initial speed of the airburst munition on the basis of a time difference between a starting point at which a signal is detected from a start signal transfer unit and an ending point at which a signal is detected from an end signal transfer unit.

In an additional aspect, the explosion controller prevents the airburst munition from exploding inside a firing barrel due to an error in the explosion timer inside the airburst munition by activating the explosion timer inside the airburst munition only when a parity bit detected from an explosion prevention signal transfer unit matches a preset parity bit.

Other features and aspects will be apparent from the following detailed description, the drawings, and the claims.

Figure 1:
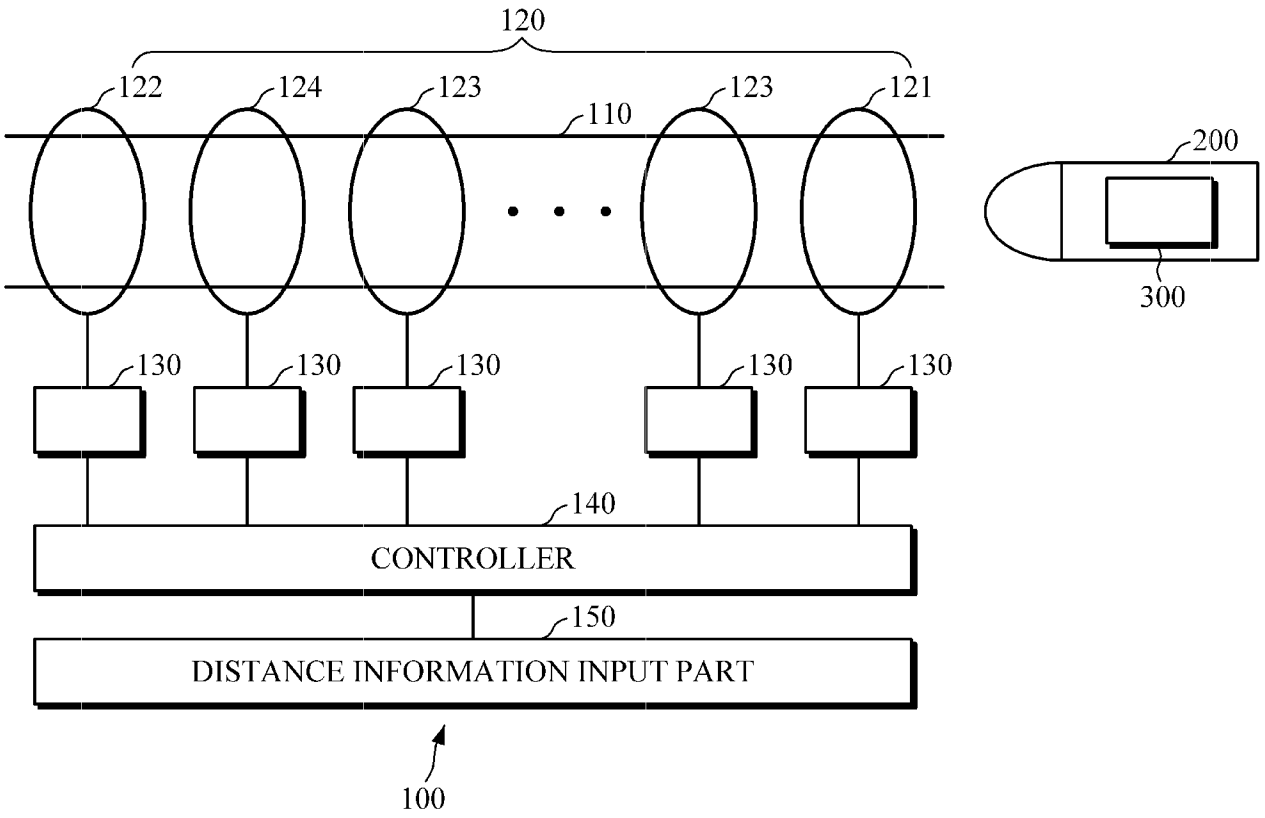
FIG. 1 is a diagram showing a configuration of an airburst signal transfer device according to an embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Hereinafter, the present invention will be described in detail to be easily understood and embodied by those skilled in the art through exemplary embodiments with reference to the accompanying drawings. Although specific embodiments are illustrated in the drawings and related detailed descriptions are discussed in the present specification, there is no intent to limit various embodiments of the present invention to particular forms.

Detailed description of well-known functions and structures incorporated herein may be omitted to avoid obscuring the subject matter of the present invention.

It will be understood that when an element is referred to as being "connected" or "coupled" to another element, it can be directly connected or coupled to the other element or intervening elements may be present.

In contrast, when an element is referred to as being "directly connected" or "directly coupled" to another element, there are no intervening elements present.

FIG. 1 is a diagram showing a configuration of an airburst signal transfer device according to an embodiment of the present invention. As shown in FIG. 1, an airburst signal transfer device 100 according to this embodiment includes a tubular body 110 and multiple signal transfer units 120. For example, the airburst signal transfer device 100 may be attached to or detached from the muzzle of a firing barrel (not shown), like a sound suppressor.

The tubular body 110 is a metal tube part which is made of steel and which has a cylindrical shape through which an airburst munition 200 is to pass. For example, the tubular body 110 may be attached to or detached from the muzzle of the firing barrel (not shown). In this case, the tubular body 110 varies in diameter depending on the diameter of the airburst munition.

The multiple signal transfer units 120 are arranged along the tubular body 110 at regular intervals and deliver multi-bit information including information regarding a distance to an airburst munition explosion location to an explosion control system inside the airburst munition 200 passing through the tubular body 110.

In this case, each of the signal transfer units 120 may be a ring coil or an electromagnet wound with coils. For example, multiple ring coils may be wound around the outer diameter or the inner diameter of the tubular body 110 at regular intervals along the tubular body 110 to form magnetic fields at regular intervals along the tubular body 110.

Meanwhile, such a signal transfer unit 120 may include a start signal transfer unit 121, an end signal transfer unit 122, and multiple data signal transfer units 123. Meanwhile, the signal transfer unit 120 may further include an explosion prevention signal transfer unit 124.

The start signal transfer unit 121 is disposed near the entrance of the tubular body to output starting point information. For example, an electric current flows clockwise through the start signal transfer unit 121 disposed near the entrance of the tubular body to form a magnetic field. A signal detector of an explosion control system inside the airburst munition, which will be described below, may detect a magnetic signal, sense the magnetic signal as starting point information, and recognize that the airburst munition, which is fired from the firing barrel, has entered the tubular body when the signal detector passes through where the start signal transfer unit 121 is disposed.

The end signal transfer unit 122 is disposed near the ending point of the tubular body to output ending point information. For example, an electric current flows clockwise through the end signal transfer unit 122 disposed near the exit of the tubular body to form a magnetic field. The signal detector of the explosion control system inside the airburst munition, which will be described below, may detect a magnetic signal, sense the magnetic signal as ending point information, and recognize that the airburst munition has exited the tubular body when the signal detector passes through where the end signal transfer unit 122 is disposed.

The multiple data signal transfer units 123 are disposed between the start signal transfer unit 121 and the end signal transfer unit 122 to output information regarding a distance to the explosion location of the airburst munition. For example, the distance information may be defined to indicate "1" when an electric current flows clockwise through the data signal transfer units 123 to form magnetic fields and "0" when an electric current flows counterclockwise through the data signal transfer units 123 to form magnetic fields.

The signal detector of the explosion control system inside the airburst munition, which will be described below, may recognize that a signal output by each data signal transfer unit 123 is "1" or "0" by sequentially detecting magnetic field directions whenever the signal detector passes through where each data signal transfer unit 123 is disposed.

For example, an 8-bit signal, i.e., 256 pieces of information, can be represented when the number of data signal transfer units 123 is eight, and a 10-bit signal, i.e., 1024 pieces of information, can be represented when the number of data signal transfer units 123 is ten.

When the number of data signal transfer units 123 is set to ten and the explosion location of the airburst munition is allowed to be set to up to 2 km, the explosion location of the airburst munition may be input at a resolution of 2 m.

The explosion prevention signal transfer unit 124 is disposed immediately in front of the end signal transfer unit 122 to prevent an explosion of the airburst munition inside the firing barrel due to an error in an explosion timer inside the airburst munition by outputting a parity bit for preventing the airburst munition from exploding inside the firing barrel. The parity bit is an error detection bit added to the last of a binary bit string.

For example, "1" may be output as a parity bit signal when an electric current flows clockwise through the explosion prevention signal transfer unit 124 to form magnetic fields, and "0" may be output as a parity bit signal when an electric current flows counterclockwise through the explosion prevention signal transfer unit 124 to form magnetic fields.

The explosion control system inside the airburst munition prevents an explosion of the airburst munition inside the firing barrel due to an error in the explosion timer inside the airburst munition by activating the explosion time inside the airburst munition only when the parity bit detected from the explosion prevention signal transfer unit 124 matches a preset parity bit.

Thus, when the airburst munition is not fired, the explosion control system inside the airburst munition cannot sense a parity bit signal and thus does not activate the explosion timer. As a result, the unfired airburst munition does not explode in the firing barrel.

According to the above implementation, by simply signaling information regarding a distance to an explosion location of an airburst munition to an explosion control system inside the airburst munition while the airburst munition passes through an airburst signal transfer device, it is possible to easily, simply, and automatically enter the information regarding the distance to the explosion location of the airburst munition to the airburst munition using the airburst signal transfer device, thus improving user convenience.

Also, according to present invention, it is possible to eliminate the inconvenience of manually setting the explosion timer of the airburst munition because the explosion timer of the airburst munition can be simply set using the information regarding the distance to the explosion location of the airburst munition, which is simply detected while the airburst munition passes through the airburst signal transfer device. Also, the present invention exhibits a high degree of safety because it is also possible to prevent the airburst munition from exploding in the firing barrel due to an error in the explosion timer.

According to an additional aspect of the present invention, the airburst signal transfer device 100 may further include multiple driving power suppliers 130. The multiple driving power suppliers 130 supply power for driving the multiple signal transfer units 120.

Figure 2:
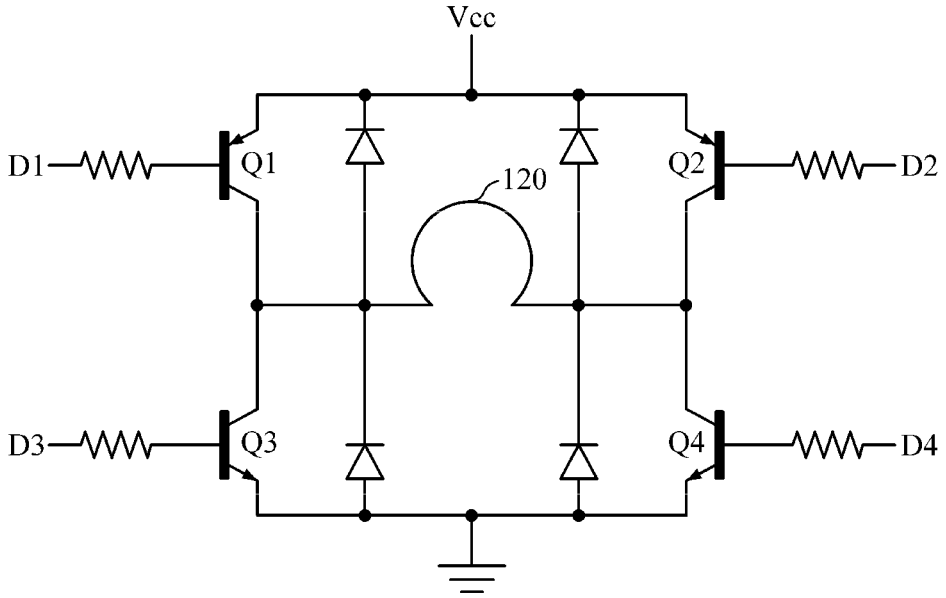
FIG. 2 is a diagram showing a configuration of a driving power supplier of an airburst signal transfer device according to an embodiment of the present invention.

As shown in FIG. 2, the driving power suppliers 130 may be implemented as an H-bridge for controlling the direction of an electric current flowing through a signal transfer unit. FIG. 2 is a diagram showing a configuration of a driving power supply unit of an airburst signal transfer device according to an embodiment of the present invention.

When a low signal is applied to D1 of the H-bridge and a high signal is applied to D4, switching diodes Q1 and Q4 are turned on, and an electric current flows clockwise through the signal transfer unit 120. On the other hand, when a low signal is applied to D2 and a high signal is applied to D3, switching diodes Q2 and Q3 are turned on, and an electric current flows counterclockwise through the signal transfer unit 120. Accordingly, it is possible to control the direction of an electric current flowing through the signal transfer unit 120.

Meanwhile, according to an additional aspect of the present invention, the airburst signal transfer device 100 may further include a controller 140. The controller 140 outputs an electric-current direction control signal to the H-bridge depending on the distance to the explosion location of the airburst munition.

For example, in order to allow an electric current to flow clockwise through the signal transfer unit 120, the controller 140 outputs, to the H-bridge, an electric-current direction control signal for applying a low signal to D1 of the H-bridge and applying a high signal to D4.

In contrast, in order to allow an electric current to flow counterclockwise through the signal transfer unit 120, the controller 140 outputs, to the H-bridge, an electric-current direction control signal for applying a low signal to D2 of the H-bridge and applying a high signal to D3.

For example, it is assumed that the electric-current direction control signal is defined to indicate "1" when an electric current flows clockwise through a signal transfer unit 120 and "0" when an electric current flows counterclockwise through a signal transfer unit 120 and also that ten data signal transfer units 123 are disposed and thus the explosion location of an airburst munition is set such that a 10-bit input can be input at a resolution of 2 m in the maximum range of 2 km.

When electric currents are controlled through the controller 140 to flow clockwise through a first data signal transfer unit close to the start signal transfer unit 121, flow counterclockwise through a second data signal transfer unit, flow clockwise through a third data signal transfer unit, flow clockwise through a fourth data signal transfer unit, and flow counterclockwise through fifth to tenth data signal transfer units, "0000001101" is obtained as a binary bit signal for the data signal transfer units and is represented by a decimal number "13." In this case, the location of the airburst munition is 26 m because the resolution of 2 m is applied per unit.

Meanwhile, according to an additional aspect of the present invention, the airburst signal transfer device 100 may further include a distance information input part 150. The distance information input part 150 receives the information regarding the distance to the explosion distance of the airburst munition. A person who will fire the airburst munition enters the information regarding the distance to the explosion location of the airburst munition where the airburst munition will explode through the distance information input part 150, such as a keypad, a touchpad, etc.

For example, it is assumed that the electric-current direction control signal is defined to indicate "1" when an electric current flows clockwise through a signal transfer unit 120 and "0" when an electric current flows counterclockwise through a signal transfer unit 120 and also that ten data signal transfer units 123 are disposed and thus the explosion location of an airburst munition is set such that a 10-bit input can be input at a resolution of 2 m in the maximum range of 2 km.

When a person who will fire the airburst munition enters 26*m* as the information regarding the distance to the explosion location of the airburst munition where the airburst munition will explode through the distance information input part 150, the controller 140 outputs, to the H-bridges of the data signal transfer units, an electric-current direction control signal for controlling electric currents to flow clockwise through the first data signal transfer unit close to the start signal transfer unit 121, flow counterclockwise through the second data signal transfer unit, flow clockwise through the third data signal transfer unit, flow clockwise through the fourth data signal transfer unit, and flow counterclockwise through fifth to tenth data signal transfer units.

Figure 3:
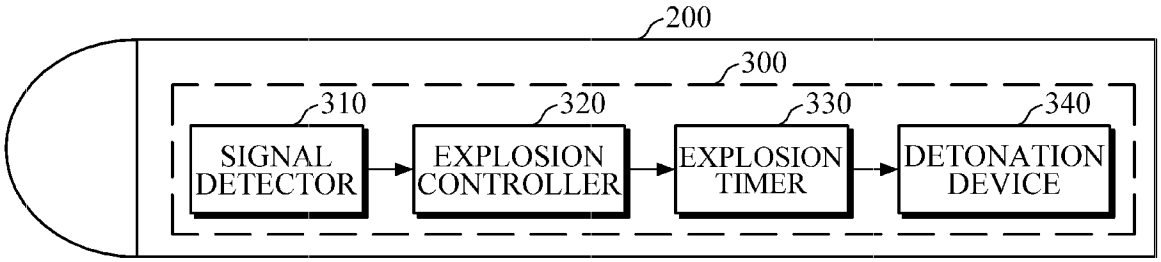
FIG. 3 is a diagram showing a configuration of an airburst munition according to an embodiment of the present invention.

FIG. 3 is a diagram showing a configuration of an airburst munition according to an embodiment of the present invention. The airburst munition 200 includes an explosion control system 300 for controlling an airburst of an airburst munition. For example, the explosion control system 300 may be installed inside a fuse of the airburst munition. As shown in FIG. 3, the explosion control system 300 includes a signal detector 310 and an explosion controller 320.

The signal detector 310 detects a signal in each of the multiple signal transfer units 120 arranged at regular intervals along the tubular body of the airburst signal transfer device 100 while the signal detector 310 passes through the tubular body of the airburst signal transfer device 100. For example, the signal detector 310 may be a magnetic sensor or a magnetic detection coil.

The explosion controller 320 recognizes the distance to the explosion location of the airburst munition and calculates an initial speed of the airburst munition on the basis of detection signals detected from the multiple signal transfer units 120, predicts an arrival time at the explosion location of the airburst munition on the basis of the recognized distance to the explosion location of the airburst munition and the calculated initial speed of the airburst munition, and sets the explosion timer 330 inside the airburst munition.

For example, when a magnetic signal is detected at the moment the signal detector 310 passes through where the start signal transfer unit 121 is disposed, the explosion controller 320 may sense the magnetic signal as starting point information and recognize that the airburst munition, which is fired from the firing barrel, has entered the tubular body.

For example, when a magnetic signal is detected at the moment the signal detector 310 passes through where the end signal transfer unit 122 is disposed, the explosion controller 320 may sense the magnetic signal as ending point information and recognize that the airburst munition has exited the tubular body.

For example, whenever the signal detector 310 sequentially passes through where the multiple data signal transfer units 123 are disposed, the explosion controller 320 may recognize a binary signal of "1" or "0" depending on the direction of a magnetic field, generate a binary bit signal by sequentially combining the binary signals recognized by the signal detector 310, convert the generated binary bit signal into a decimal number, and recognize a distance to the explosion location of the airburst munition by reflecting a distance resolution in the decimal number.

Meanwhile, the explosion controller 320 may calculate the initial speed of the airburst munition on the basis of the time difference between the starting point at which the signal is detected from the start signal transfer unit 121 and the ending point at which the signal is detected from the end signal transfer unit 122.

The distance between the start signal transfer unit 121 and the end signal transfer unit 122 is a previously-known value, and the starting point at which the signal is detected from the start signal transfer unit 121 and the ending point at which the signal is detected from the end signal transfer unit 122 are time values detected by the signal detector 310.

Accordingly, the initial speed of the airburst munition may be calculated by dividing the distance between the start signal transfer unit 121 and the end signal transfer unit 122 by the time difference between the starting point at which the signal is detected from the start signal transfer unit 121 and the ending point at which the signal is detected from the end signal transfer unit 122.

When the distance to the explosion location of the airburst munition is recognized and the initial speed of the airburst munition is calculated, the explosion controller 320 calculates an arrival time at the explosion location of the airburst munition on the basis of the distance to the explosion location of the airburst munition and the initial speed of the airburst munition and sets the explosion timer 330 inside the airburst munition.

When the explosion timer 330 is set, the explosion timer 330 counts time. When the counted time reaches a preset explosion time, the explosion controller 320 signals to a detonation device 340 to explode the airburst munition.

According to the above implementation, by simply signaling information regarding a distance to an explosion location of an airburst munition to an explosion control system inside the airburst munition while the airburst munition passes through an airburst signal transfer device, it is possible to easily, simply, and automatically enter the information regarding the distance to the explosion location of the airburst munition to the airburst munition using the airburst signal transfer device, thus improving user convenience.

Also, according to present invention, it is possible to eliminate the inconvenience of manually setting the explosion timer of the airburst munition because the explosion timer of the airburst munition can be simply set using the information regarding the distance to the explosion location of the airburst munition, which is simply detected while the airburst munition passes through the airburst signal transfer device. Also, the present invention exhibits a high degree of safety because it is also possible to prevent the airburst munition from exploding in the firing barrel due to an error in the explosion timer.

Meanwhile, according to an additional aspect of the present invention, by the explosion controller 320 activating the explosion timer 330 inside the airburst munition only when a parity bit detected from the explosion prevention signal transfer unit matches a preset parity bit, it is possible to prevent the airburst munition from exploding inside the firing barrel due to an error in the explosion timer inside the airburst munition.

The explosion prevention signal transfer unit 124 is disposed immediately in front of the end signal transfer unit 122 to output a parity bit for preventing the airburst munition from exploding inside the firing barrel.

The signal detector 310 detects a parity bit signal at the moment the signal detector 310 passes through where the explosion prevention signal transfer unit 124 is disposed. The explosion controller 320 activates the explosion timer 330 inside the airburst munition, recognizes a distance to the explosion location of the airburst munition, calculates an initial speed of the airburst munition, calculates an arrival time at the explosion location of the airburst munition on the basis of the distance and the initial speed, and sets the activated explosion timer 330 inside the airburst munition only when a detected parity bit matches a preset parity bit.

According to the above implementation, when the airburst munition is not fired, the explosion controller 320 of the explosion control system 300 inside the airburst munition cannot sense an explosion timer activation signal and thus does not activate the explosion timer. As a result, the unfired airburst munition does not explode in the firing barrel.

Figure 4:
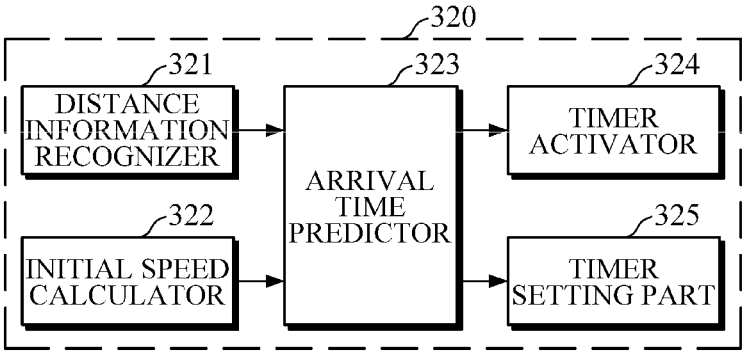
FIG. 4 is a diagram showing a configuration of an explosion controller of an airburst munition according to an embodiment of the present invention.

FIG. 4 is a diagram showing a configuration of an explosion controller of an airburst munition according to an embodiment of the present invention. As shown in FIG. 4, the explosion controller 320 includes a distance information recognizer 321, an initial speed calculator 322, an arrival time predictor 323, a timer activator 324, and a timer setting part 325.

The distance information recognizer 321 recognizes a distance to the explosion location of the airburst munition on the basis of detection signals detected from the multiple signal transfer units 120 by the signal detector 310.

For example, depending on the direction of a magnetic field detected whenever the signal detector 310 sequentially passes through where the multiple data signal transfer units 123 are disposed, the distance information recognizer 321 may recognize a binary signal of "1" or "0," generate a binary bit signal by sequentially combining the recognized binary signals, convert the generated binary bit signal into a decimal number, and recognize a distance to the explosion location of the airburst munition by reflecting a distance resolution in the decimal number.

The initial speed calculator 322 calculates the initial speed of the airburst munition. For example, the initial speed calculator 322 may calculate the initial speed of the airburst munition on the basis of the time distance between the starting point at which the signal is detected from the start signal transfer unit 121 and the ending point at which the signal is detected from the end signal transfer unit 122.

The distance between the start signal transfer unit 121 and the end signal transfer unit 122 is a previously-known value, and the starting point at which the signal is detected from the start signal transfer unit 121 and the ending point at which the signal is detected from the end signal transfer unit 122 are time values detected by the signal detector 310.

Accordingly, the initial speed of the airburst munition may be calculated by dividing the distance between the start signal transfer unit 121 and the end signal transfer unit 122 by the time difference between the starting point at which the signal is detected from the start signal transfer unit 121 and the ending point at which the signal is detected from the end signal transfer unit 122.

The arrival time predictor 323 predicts an arrival time at the explosion location of the airburst munition on the basis of the distance to the explosion location of the airburst munition which is recognized by the distance information recognizer 321 and the initial speed of the airburst munition which is calculated by the initial speed calculator 322.

When the distance to the explosion location of the airburst munition is recognized and the initial speed of the airburst munition is calculated, the arrival time predictor 323 calculates an arrival time at the explosion location of the airburst munition on the basis of the distance to the explosion location of the airburst munition and the initial speed of the airburst munition.

The timer activator 324 activates the explosion timer inside the airburst munition. A parity bit is detected at the moment the signal detector 310 passes through where the explosion prevention signal transfer unit 124 is disposed, and the timer activator 324 activates the explosion timer 330 of the airburst munition when the detected parity bit matches a preset parity bit.

The timer setting part 325 sets the explosion timer inside the airburst munition according to the arrival time at the explosion location of the airburst munition which is predicted by the arrival time predictor 323. When the explosion timer 330 inside the airburst munition is activated by the timer activator 324, the timer setting part 325 sets the explosion timer 330 inside the airburst munition according to the arrival time at the explosion location of the airburst munition which is predicted by the arrival time predictor 323.

When the explosion timer 330 is set, the explosion timer 330 counts time. When the counted time reaches a preset explosion time, the explosion controller 320 signals to a detonation device 340 to explode the airburst munition.

As described above, according to the present invention, by simply signaling information regarding a distance to an explosion location of an airburst munition to an explosion control system inside the airburst munition while the airburst munition passes through a tubular body of an airburst signal transfer device, it is possible to easily, simply, and automatically enter the information regarding the distance to the explosion location of the airburst munition to the airburst munition using the airburst signal transfer device, thus improving user convenience.

Also, according to present invention, it is possible to eliminate the inconvenience of manually setting the explosion timer of the airburst munition because the explosion timer of the airburst munition can be simply set using the information regarding the distance to the explosion location of the airburst munition, which is simply detected while the airburst munition passes through the tubular body of the airburst signal transfer device.

Also, the present invention exhibits a high degree of safety because it is also possible to prevent the airburst munition from exploding in the firing barrel due to an error in the explosion timer.

The various embodiments disclosed in the specification and drawings are merely presented as specific examples for the purpose of understanding and are not intended to limit the scope of the present invention.

Therefore, all changes or modifications derived based on the technical spirit of the various embodiments of the present invention in addition to the embodiments described herein should be construed as falling within the scope of the present invention.

What is claimed is:

1. An airburst signal transfer device comprising:

a tubular body through which an airburst munition is to pass; and multiple signal transfer units disposed at regular intervals along the tubular body and configured to deliver, to an explosion control system inside the airburst munition passing through the tubular body, multi-bit information including information regarding a distance to an explosion location of the airburst munition, wherein the signal transfer units comprise:

a start signal transfer unit disposed near an entrance of the tubular body and configured to output starting point information;

an end signal transfer unit disposed near an exit of the tubular body and configured to output ending point information; and multiple data signal transfer units disposed between the start signal transfer unit and the end signal transfer unit and configured to output the information regarding the distance to the explosion location of the airburst munition.

2. The airburst signal transfer device of claim 1, wherein the signal transfer units further comprise an explosion prevention signal transfer unit disposed immediately in front of the end signal transfer unit and configured to output a parity bit for preventing the airburst munition from exploding inside a firing barrel in order to prevent the airburst munition from exploding inside the firing barrel due to an error in an explosion timer inside the airburst munition.

3. The airburst signal transfer device of claim 1, further comprising multiple driving power suppliers configured to supply power for driving the multiple signal transfer units.

4. The airburst signal transfer device of claim 3, wherein each of the driving power suppliers is an H-bridge configured to control a direction of an electric current flowing through a corresponding signal transfer unit.

5. The airburst signal transfer device of claim 4, further comprising a controller configured to output an electric-current direction control signal to each H-bridge depending on the distance to the explosion location of the airburst munition.

6. The airburst signal transfer device of claim 5, further comprising a distance information input part configured to receive the information regarding the distance to the explosion location of the airburst munition.

7. An airburst munition including an explosion control system for performing airburst control of the airburst munition, the explosion control system comprising:

a signal detector configured to detect signals from multiple signal transfer units disposed at regular intervals along a tubular body of an airburst signal transfer device when the airburst munition passes through the tubular body of the airburst signal transfer device; and an explosion controller configured to recognize a distance to an explosion location of the airburst munition and calculate an initial speed of the airburst munition on the basis of the signals detected from the multiple signal transfer units, predict an arrival time at the explosion location of the airburst munition on the basis of the recognized distance to the explosion location of the airburst munition and the calculated initial speed of the airburst munition, and set an explosion timer inside the airburst munition, wherein the explosion controller prevents the airburst munition from exploding inside a firing barrel due to an error in the explosion timer inside the airburst munition by activating the explosion timer inside the airburst munition only when a parity bit detected from an explosion prevention signal transfer unit matches a preset parity bit.

8. The airburst munition of claim 7, wherein the explosion controller calculates the initial speed of the airburst munition on the basis of a time difference between a starting point at which a signal is detected from a start signal transfer unit and an ending point at which a signal is detected from an end signal transfer unit.

* * * * *